US008047213B2

(12) United States Patent
Yasuda

(10) Patent No.: US 8,047,213 B2
(45) Date of Patent: Nov. 1, 2011

(54) COSMETIC COATING IMPLEMENT AND COSMETIC COATING SET

(76) Inventor: Aya Yasuda, West Hollywood, CA (US)

( * ) Notice: Subject to any disclaimer, the term of this patent is extended or adjusted under 35 U.S.C. 154(b) by 0 days.

(21) Appl. No.: 11/134,751

(22) Filed: May 20, 2005

(65) Prior Publication Data

US 2005/0257802 A1 Nov. 24, 2005

(30) Foreign Application Priority Data

May 24, 2004 (JP) ..... 2004-154018

(51) Int. Cl.
*A45D 40/26* (2006.01)
*A46B 9/02* (2006.01)

(52) U.S. Cl. ..... 132/218; 15/160; 15/206

(58) Field of Classification Search ..... 132/320, 132/218, 318; 15/160, 164, 206
See application file for complete search history.

(56) References Cited

U.S. PATENT DOCUMENTS

| | | | | | |
|---|---|---|---|---|---|
| 422,117 | A * | 2/1890 | Christoffel | 15/104.16 |
| 818,086 | A * | 4/1906 | Gohrband | 15/179 |
| 877,324 | A * | 1/1908 | Gilbert | 131/245 |
| 1,206,273 | A * | 11/1916 | Veec et al. | 15/179 |
| 1,996,897 | A * | 4/1935 | Blinn | 604/289 |
| 4,194,848 | A * | 3/1980 | Kingsford | 401/5 |
| 4,446,880 | A * | 5/1984 | Gueret et al. | 132/218 |
| 4,527,575 | A * | 7/1985 | Vasas | 132/218 |
| 4,545,393 | A * | 10/1985 | Gueret et al. | 132/218 |
| 4,861,179 | A * | 8/1989 | Schrepf et al. | 401/129 |
| 5,816,728 | A * | 10/1998 | Nardolillo et al. | 401/126 |
| 6,440,557 | B1 * | 8/2002 | Naghibi | 428/397 |
| 6,792,955 | B1 | 9/2004 | Newell | |
| 6,810,885 | B2 | 11/2004 | Montoli et al. | |
| 2003/0172485 | A1 * | 9/2003 | Dumler et al. | 15/206 |

FOREIGN PATENT DOCUMENTS

| | | | |
|---|---|---|---|
| GB | 2 170 996 | A * | 8/1986 |
| JP | 05-192226 | | 8/1993 |
| JP | 06-022815 | | 2/1994 |
| JP | 2003-111616 | | 4/2003 |

* cited by examiner

*Primary Examiner* — Rachel Steitz
(74) *Attorney, Agent, or Firm* — DLA Piper LLP (US)

(57) ABSTRACT

A cosmetic coating implement which is used to apply a cosmetic material such as mascara or the like as a coating, comprising a coating part in which brush bristles are disposed on a shaft member, and a holding part which is held in order to use the coating implement and which is connected to the shaft member. In this cosmetic coating implement, the brush bristles disposed on the shaft member have two or more protruding parts comprising curved surfaces with respect to the direction of length of the shaft such as parts with a spherical or elliptical shape, and these protruding parts are symmetrically disposed with the shaft member as an axis.

5 Claims, 5 Drawing Sheets

FIG. 1(a)
FIG. 1(b)
FIG. 1(c)
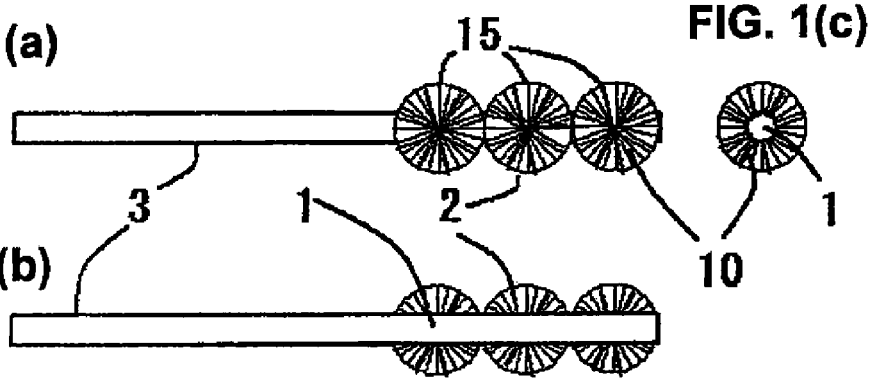
FIG. 2(a)
FIG. 2(b)
FIG. 2(c)
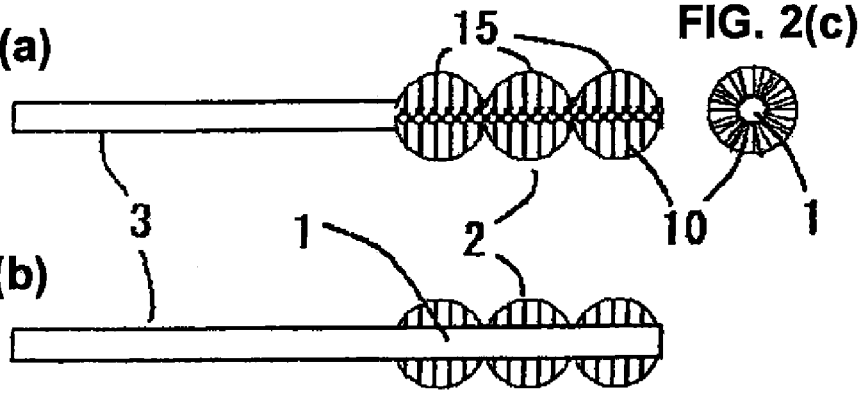
FIG. 3
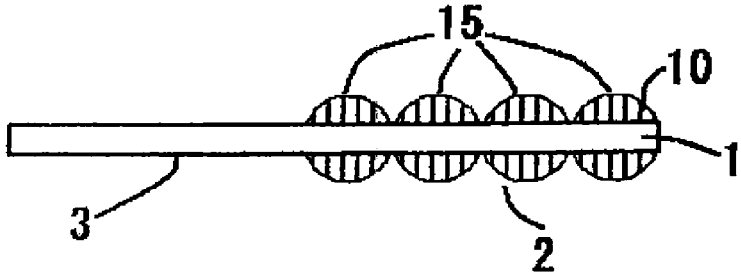

COSMETIC COATING IMPLEMENT AND COSMETIC COATING SET

BACKGROUND OF THE INVENTION

1. Field of the Invention

The present invention relates to a cosmetic coating implement and a cosmetic coating set.

2. Description of the Prior Art

Makeup items that have shown an increase in users in the past, and that are now considered indispensable, include mascara. Mascara is relatively easy to use and has a high cosmetic effect on the eyelashes. Mascara is produced by mixing a pigment such as a black pigment, etc. with a viscous liquid substance, and is commonly used as an eyelash cosmetic. The attractiveness and impression of the eyes are greatly influenced by the conditions of application of such mascara; this cosmetic makes it possible to achieve a beautiful and attractive appearance of the eyes.

A coating brush having a configuration in which brush members are clamped between two metal wires in an intersecting configuration with respect to the metal wires, and the metal wires are twisted into a spiral shape so that the brush members are fastened between the loops, is widely used as a coating implement for the application of mascara. Here, in a conventional coating brush, the lengths of the respective brush members extending radially from the metal wires are generally the same.

However, in the case of such a structure, the brush is inserted into the container accommodating the mascara and dipped into the mascara, and is then removed and wiped on the mouth portion of the container, so that the amount of mascara adhering to the bristle tips of the brush members is reduced. Accordingly, the following problems arise: namely, the mascara does not adhere uniformly when applied to the eyelashes, so that the application is uneven, and it may be necessary to use mascara several times.

For example, in Japanese Patent Application Kokai No. H6-22815 and Japanese Patent Application Kokai No. H5-192226, brush bristles in which rigid bristles with a large cross-sectional area and rigid bristles with a relatively small cross-sectional area are mixed, and in which the lengths of the brush bristles are mixed, are proposed as brush bristles.

Furthermore, in Japanese Patent Application Kokai No. 2003-111616 "Cosmetic Coating Brush and Method for Manufacturing the Same", a cosmetic coating brush with a simple structure is proposed in which the content liquid of mascara or the like can be amply and uniformly held in the direction of length and circumferential direction of the brush by applying this liquid from the central portions to the tip end portions of the respective brush bristles, so that a good volume application effect can be obtained by a coating operation without any further addition of the liquid. The brush bristles are disposed between metal core wires so as to intersect with these wires, and the core wires are wound in a spiral configuration, so that a coating brush part is formed. In this cosmetic coating brush, the coating brush part is a part in which long brush bristles and short brush bristles are disposed alternately and symmetrically with the core wires as an axis in the cross section oriented in the axial direction of the coating brush part.

In such a structure, however, depending on the disposition of the two types of rigid bristles, adhesion of the liquid may be non-uniform, so that uniform coating of the eyelashes is difficult, as a result of short brush bristles being concentrated in certain portions, and long brush members being concentrated in other portions.

If mascara is merely applied in large amounts, the painstakingly achieved attractiveness of mascara is reduced substantially. The removal of excessively adhering mascara and balls of mascara, and combing that blends the mascara into the eyelashes, influence the mascara finish. The mascara brush that is used for this finishing work is important.

However, the structures of conventionally used mascara brushes are all similar, and most people use combs or screw brushes meant for combined use on the eyebrows.

If it were possible to construct a mascara brush that made it possible to apply mascara to the hairs of the eyelashes one by one so that a naturally separated state could be obtained, that also made it possible to dissolve balls or bundles of excessively adhering mascara, and that made it possible to blend mascara into the eyelashes without any irregularities, this would be desirable. Moreover, if it were possible to replenish mascara in a simple manner in cases where an additional coating of mascara is superimposed, this would also be desirable.

SUMMARY OF THE INVENTION

It is an object of the present invention to solve the various problems mentioned above, and to provide a cosmetic coating implement [i] which can apply mascara or the like to the eyelashes as a coating in appropriate amounts, [ii] which can adjust mascara adhering to the eyelashes in excessive amounts by scraping away or dissolving this mascara, [iii] which can replenish mascara without inserting the implement into the container a number of times and adding mascara, and [iv] which can reduce complicated operations of adding liquid. Furthermore, it is also an object of the present invention to provide a cosmetic coating implement which can dissolve balls or bundles of excessively adhering mascara, and which can blend mascara into the eyelashes without any irregularities.

In order to solve the above-described problems, the present invention teaches a cosmetic coating implement for applying a cosmetic material such as mascara or the like comprising a coating part in which brush bristles are disposed on a shaft member and a holding part which is held in order to use said coating implement and connected to said shaft member being characterized in that said brush bristles disposed on said shaft member have at least two protruding parts comprising curved surfaces with respect to the direction of length of said shaft and said protruding parts are symmetrically disposed along said shaft member.

Furthermore, in order to solve the above-described problems, the invention further teaches a cosmetic coating implement which is characterized by the fact that the above-described brush bristles disposed on the shaft member have two or more protruding parts including curved surfaces that are parts of an elliptical arc or spherical with respect to the direction of length of the shaft, and the above-described protruding parts are symmetrically disposed with the shaft member as an axis.

BRIEF DESCRIPTION OF THE DRAWINGS

FIGS. 1(*a*) through 1(*c*) show one preferred embodiment of the cosmetic coating implement of the present invention.

FIGS. 2(*a*) and 2(*b*) show one preferred embodiment of the cosmetic coating implement of the present invention.

FIG. 3 shows one preferred embodiment of the cosmetic coating implement of the present invention.

DETAILED DESCRIPTION OF THE PREFERRED EMBODIMENT

Figure 4A:
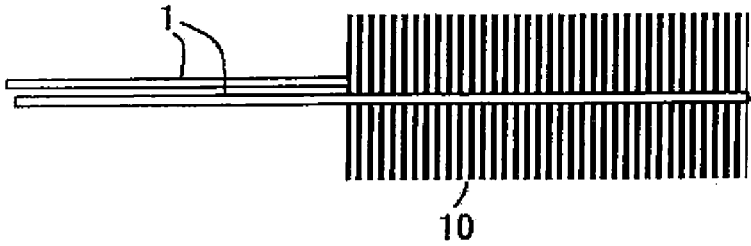
FIGS. 4(*a*) and 4(*b*) show one preferred embodiment of the cosmetic coating implement of the present invention.

An embodiment of the present invention will be described below with reference to the attached figures.

FIGS. 1 through 12 show preferred embodiments of the cosmetic coating implement of the present invention.

In the respective figures, the symbol 1 denotes a shaft member, the symbol 2 denotes a coating part, and the symbol 3 denotes a holding part. Furthermore, the symbol 10 denotes brush bristles, and the symbol 15 denotes protruding parts.

In FIG. 1 and the respective other figures, (a) shows a front view, (b) shows a sectional view in the direction of length, and (c) shows a sectional view centered on the shaft member 1.

The cosmetic coating implement of the present invention is a coating implement that is used to apply a cosmetic material such as mascara or the like, and comprises configurations such as those shown in the respective figures.

First, a typical configuration of the cosmetic coating implement of the present invention will be described with reference to FIGS. 1 through 3.

The cosmetic coating implement of the present invention comprises a coating part 2 in which brush bristles 10 are disposed on a shaft member 1.

The coating part 2 is a part which has the actions of applying mascara as a coating, removing excessively adhering mascara liquid or balls (i. e., lumps), and blending mascara into the eyelashes. In particular, this coating part 2 is used for combing that produces an attractive mascara finish.

In regard to the brush bristles 10 that are used, bristles consisting of various materials and having various softness can be selected and used in accordance with the finish and type of mascara used. An arbitrary material such as nylon, etc., can be used as the material of the brush bristles 10, and the cross section of the bristles may be solid or hollow.

For example, if the bristle material is soft and the quantity of brush bristles 10 is large, the brush bristles 10 become well entwined with the eyelashes, so that a fine finish is obtained. Furthermore, in cases where a volume effect is obtained by applying a superimposed layer of mascara to the eyelashes, a brush with a hard bristle material and a small quantity of brush bristles 10 is generally ideal.

The shaft member 1 may have a configuration in which brush bristles 10 are attached to core wires that are wound in a spiral configuration or the like, using metal core wires consisting of a resin or metal. Furthermore, other types of materials may also be used. The shaft member 1 generally has a cylindrical rod-form configuration; however, the present invention is not limited to this. Furthermore, various thicknesses may be used; there are no particular restrictions on the thickness of the shaft member 1.

The construction of the coating part 2 on which the brush bristles 10 are disposed will be described later.

Next, the cosmetic coating implement of the present invention comprises a holding part 3 which is held by the fingers of the user in order to use the coating implement, and which is connected to the above-described shaft member 1.

The holding part 3 can be made of resin, metal or various types of materials. The shaft member 1 general has a cylindrical rod-form configuration; however, the present invention is not limited to this. Furthermore, various thicknesses may be used; there are no particular restrictions on the thickness of the holding part 3.

Furthermore, in regard to the shaft member 1, slender metal core wires, etc., can be used in the coating part 2, and the holding part 3 that is held by the fingers may have a thickness that is suitable for being held by the hands, with slender core wires, etc., sealed inside. If the shaft member 1 of the coating part is made slender, then the length of the brush bristles 10 can be effectively utilized from the tip ends to the roots. On the other hand, since the holding part 3 held by hand is difficult to hold if this part is too slender, it is desirable that this part have a suitable thickness.

In the coating part 2, the brush bristles 10 are disposed so that these bristles are fastened to the shaft member 1.

In the cosmetic coating implement of the present invention, the brush bristles 10 disposed on the shaft member 1 have two or more protruding parts 15 consisting of curved surfaces with respect to the direction of length of the shaft. The protruding parts 15 are disposed symmetrically with the shaft member 1 as an axis.

Referring to FIGS. 1 and 2, (a) shows a front view, (b) shows a sectional view in the direction of length, and (c) shows a sectional view centered on the shaft member 1.

In the cosmetic coating implement shown in FIG. 1, the protruding parts 15 consist of three protruding parts 15 that are disposed symmetrically with the shaft member 1 as an axis. Similarly, in FIG. 2 as well, the protruding parts 15 comprise three protruding parts 15 that are disposed symmetrically with the shaft member 1 as an axis.

Here, comparing FIGS. 1 and 2, both sets of protruding parts 15 are disposed so that these parts form substantially spherical shapes that are with the shaft member 1 as an axis; however, in FIG. 1, the spherical shape is disposed so that the tip ends of the brush bristles 10 are oriented radially in all directions from the center.

On the other hand, in FIG. 2, as is shown in the sectional view (b) in the direction of length, the brush bristles 10 are disposed in a mutually parallel orientation so that the brush bristles 10 are perpendicular to the shaft member 1. The brush bristles 10 are fastened with the orientation with respect to the shaft varied so that two or more protruding parts 15 including curved surfaces that form one part of a circular arc, elliptical arc or parabola are formed with respect to the direction of length of the shaft.

In a desirable configuration of the present invention, the brush bristles 10 disposed on the shaft member 1 have two or more protruding-parts 15 including curved surfaces that form one part of a circular arc, elliptical arc or parabola with respect to the direction of length of the shaft, and these protruding parts 15 are symmetrically disposed with the shaft member as an axis. There are no particular restrictions on the number of protruding parts 15; preferably, however, at least thee substantially spherical or substantially ellipsoidal protruding parts 15 are disposed so that these parts are connected to the shaft member.

In FIGS. 1 and 2, three protruding parts 15 are disposed. Furthermore, in FIG. 3, four protruding parts 15 are disposed.

Here, various configurations of the brush bristles 10 will be described.

As was described above, the shaft member 1 may have a configuration in which brush bristles 10 are attached to core wires that are wound in a spiral configuration or the like, using metal core wires consisting of a resin or metal.

Figure 4B:
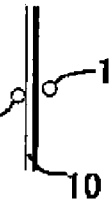
Figure 5A:
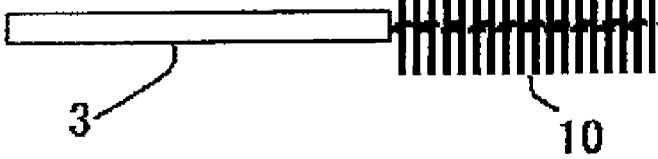
FIGS. 5(*a*) and 5(*b*) show one preferred embodiment of the cosmetic coating implement of the present invention.
Figure 5B:
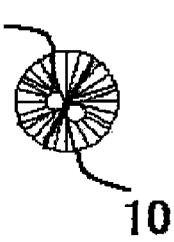
Figure 6A:
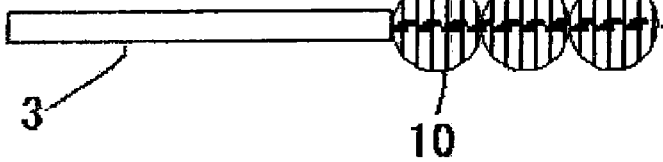
FIGS. 6(*a*) and 6(*b*) show one preferred embodiment of the cosmetic coating implement of the present invention.
Figure 6B:
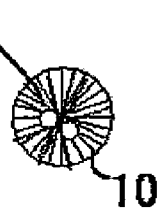
Figure 7:
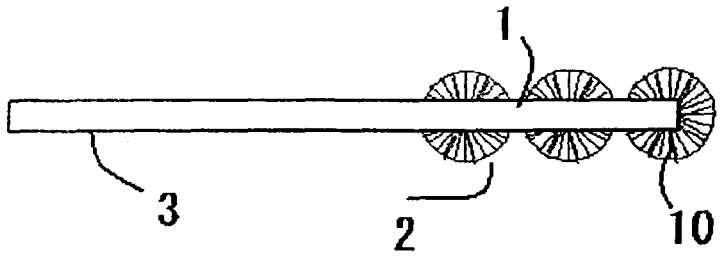
FIG. 7 shows one preferred embodiment of the cosmetic coating implement of the present invention.

One example of the manufacturing process in cases where the brush bristles 10 are fastened to core wires wound in a spiral configuration using metal core wires is shown in FIGS. 4 through 6.

In the working configuration shown for example in FIGS. 4 through 6, as is shown first of all in FIGS. 4(*a*) and 4(*b*), two core wires are used for the shaft member 1. Furthermore, the necessary quantity of brush bristles 10 is clamped between the two core wires.

In this state, the two core wires are wound into a spiral configuration until the brush bristles 10 are tightly fastened, so that the brush bristles 10 face uniformly in all directions around the circumference, with the shaft member 1 as an axis. The portions of the brush bristles 10 that intersect with the core wires are fastened by the spiral loops, so that the respective bristles are disposed as bundles with a specified volume.

Next, a cosmetic coating implement of the type shown for example in FIGS. 2(*a*), 2(*b*) and 2(*c*) are formed by cutting appropriate brush bristles 10 so that a plurality of protruding parts 15 are formed. The brush bristles 10 are cut so that two or more protruding parts 15 including curved surfaces that form one part of a circular arc, elliptical arc or parabola are formed with respect to the direction of length of the shaft.

Furthermore, the cosmetic coating implement manufacturing process shown here is merely an example; various cosmetic coating implements can be manufactured by various manufacturing processes as shown in the respective embodiments indicated in this specification and in the respective figures.

In the cosmetic coating implement of the present invention, the brush bristles 10 disposed on the shaft member 1 have two or more protruding parts that have a substantially spherical or substantially ellipsoidal shape with respect to the direction of length of the shaft, and the above-described protruding parts are symmetrically disposed with the shaft member as an axis.

Here, in FIGS. 1 through 3, an example is shown in which the brush bristles 10 disposed on the shaft member 1 form a substantially spherical shape with respect to the direction of length of the shaft.

Furthermore, FIGS. 4(*a*) and 4(*b*) show one example of a modification in which the spacing between the protruding parts 15 is altered. The brush bristles 10 form substantially spherical shapes, and a certain gap is left between these spherical shapes. Furthermore, the spherical shape on the tip end portion protrudes further from the shaft member 1 by an amount equal to the length of the brush bristles 10, and since the tip end consists only of the brush bristles 10, this tip end is soft.

Figure 8:
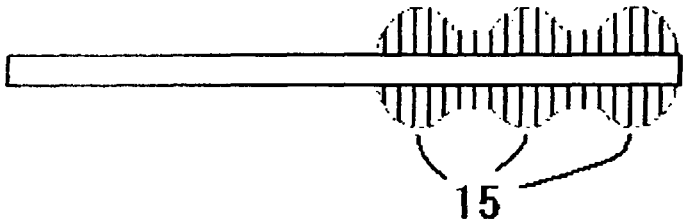
FIG. 8 shows one preferred embodiment of the cosmetic coating implement of the present invention.
Figure 9:
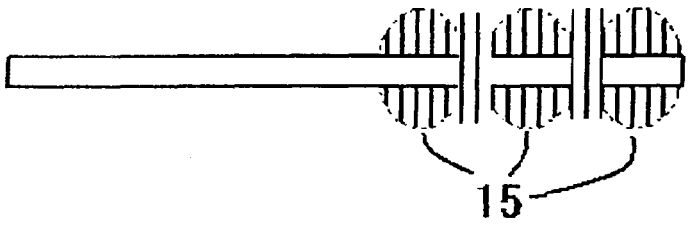
FIG. 9 shows one preferred embodiment of the cosmetic coating implement of the present invention.

Furthermore, FIGS. 8 and 9 show an example of another modification in which the spacing of the elliptical protruding parts 15 is altered.

In the example shown here, the spacing of the elliptical protruding parts 15 is somewhat widened, and brush bristles 10 that are shorter than the protruding parts 15 are implanted between the elliptical protruding parts 15.

Figure 10:
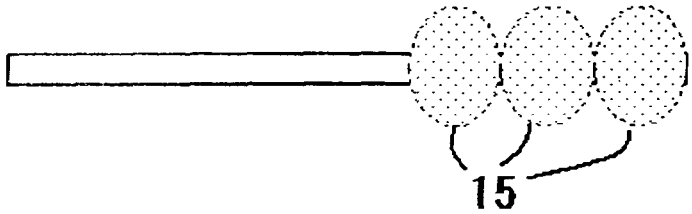
FIG. 10 shows one preferred embodiment of the cosmetic coating implement of the present invention.
Figure 11:
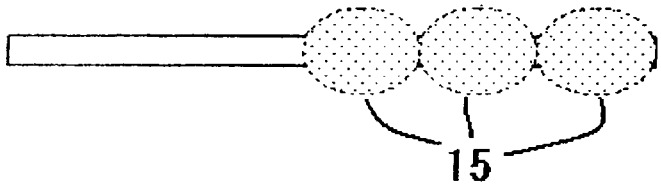
FIG. 11 shows one preferred embodiment of the cosmetic coating implement of the present invention.
Figure 12:
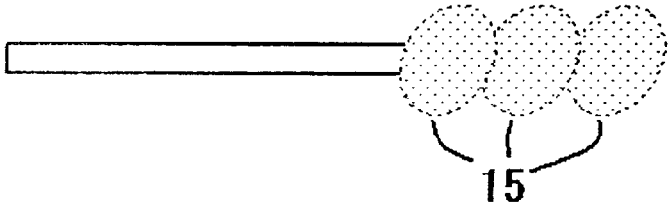
FIG. 12 shows one preferred embodiment of the cosmetic coating implement of the present invention.

Furthermore, FIGS. 10 and 11 show an example in which the protruding parts 15 are formed with an elliptical shape. Furthermore, as is shown in FIG. 12, the bristles may be disposed with an angle in the elliptical shape.

Next, the operation of the cosmetic coating implement of the present invention will be described.

The cosmetic coating implement of the present invention described above can be combined with a cosmetic material accommodating container, thus forming a cosmetic coating set which is devised so that the above-described cosmetic coating implement is accommodated in the cosmetic material accommodating container.

Like a conventional coating brush, the cosmetic coating implement of the present invention is inserted into the mascara container and dipped into the mascara, and the cosmetic coating implement with mascara adhering to the coating part 2 is pulled out of the accommodating container.

Figure 13:
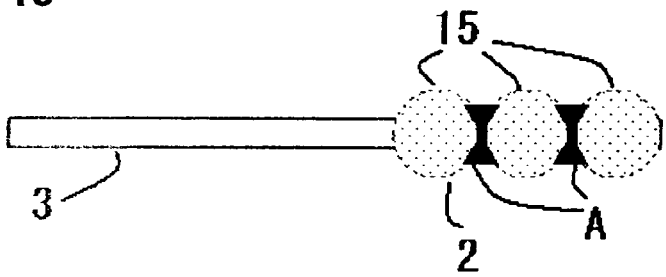
FIG. 13 shows one preferred embodiment of the cosmetic coating implement of the present invention.

The brush bristles 10 of the coating part 2 are caused to contact the eyelashes. In the present invention, however, as is shown in the respective figures, a plurality of protruding parts 15 are disposed. Accordingly, when the brush is squeezed in the mouth of the container, the excessive mascara adhering to the brush bristles 10 of the respective protruding parts 15 is squeezed and adjusted to an appropriate amount; furthermore, an ample amount of mascara A is held in the spaces between the respective protruding parts 15 by surface tension as shown in FIG. 13.

Accordingly, an appropriate amount of mascara can be applied as a coating to the eyelashes; furthermore, excessive mascara adhering to the eyelashes can be adjusted by being scraped away or dissolved. Furthermore, excessive mascara adhering to the brush bristles 10 of the protruding parts 15 can be scattered by being squeezed by the edges of the mouth of the container or the like. Moreover, since this scattered mascara A is held between the protruding parts 15 (without adding mascara by inserting the implement into the container a number of times), the mascara held between the protruding parts 15 can be replenished merely by moving the cosmetic coating implement. Accordingly, there is no need for a complex operation that adds liquid.

Next, still another working configuration of the present invention will be described.

Figure 14:
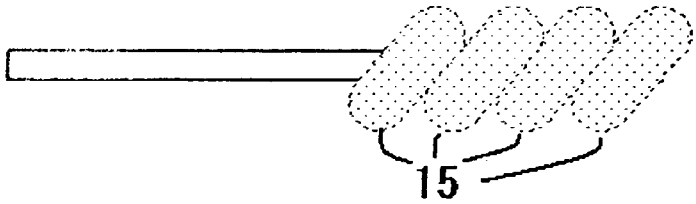
FIG. 14 shows one preferred embodiment of the cosmetic coating implement of the present invention.

FIG. 14 shows one example of this working configuration.

As described above, this working configuration is a coating implement used to apply a cosmetic materials such as mascara or the like as a coating; this implement comprises a coating part 2 in which brush bristles 10 are disposed on a shaft member 1, and a holding part 3 which is held in order to use the coating implement, and which is connected to the shaft member 1.

In the present working configuration as well, the brush bristles 10 disposed on the shaft member 1 have two or more protruding parts 15 consisting of curved surfaces with respect to the direction of length of the shaft.

Here, the characterizing feature in this working configuration is that the protruding parts 15 are disposed in a spiral configuration with the shaft member 1 as an axis.

Furthermore, as is shown in examples of various configurations in FIGS. 1 through 12, the shaft member 1 and brush bristles 10 may also have various types of constructions in the case of a configuration in which the protruding parts 15 are disposed in a spiral configuration with the shaft member 1 as an axis.

The operation of the cosmetic coating implement of the present working configuration will be described.

As was described above, the cosmetic coating implement of the present invention is inserted into the mascara container and dipped into the mascara; then, the cosmetic coating implement with mascara adhering to the coating part 2 is pulled out of the accommodating container.

The brush bristles 10 of the coating part 2 are caused to contact the eyelashes. In the present working configuration, however, a plurality of protruding parts 15 are disposed in a spiral configuration as shown in FIG. 14. Accordingly, when the brush is squeezed in the mouth of the container, the excess mascara adhering to the brush bristles 10 of the respective protruding parts 15 is squeezed and adjusted to an appropriate amount; furthermore, an ample amount of mascara A is held in the spaces between the respective protruding parts 15 (in a spiral configuration) by surface tension as shown in FIG. 3.

Accordingly, an appropriate amount of mascara can be applied as a coating to the eyelashes; furthermore, excessive mascara adhering to the eyelashes can be adjusted by being scraped away or dissolved. Furthermore, excessive mascara adhering to the brush bristles 10 of the protruding parts 15 can be scattered by being squeezed by the edges of the mouth of the container or the like. Moreover, since this scattered mascara A is held between the protruding parts 15 without adding mascara by inserting the implement into the container a number of times, the mascara held between the protruding parts 15 can be replenished merely by moving the cosmetic coating implement.

Figure 15:
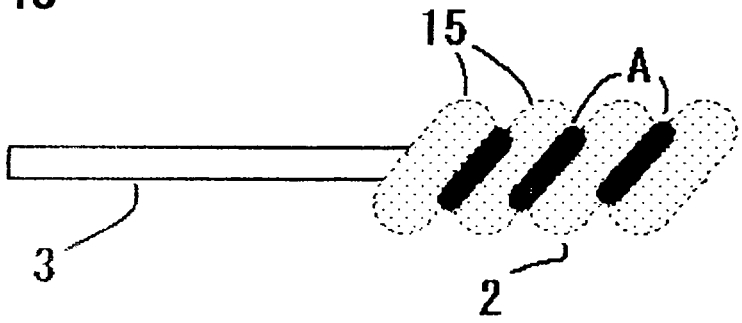
FIG. 15 shows one preferred embodiment of the cosmetic coating implement of the present invention.

Moreover, in the present working configuration, the protruding parts 15 are formed in a spiral configuration, and the parts between the protruding parts 15 where the mascara A is held are also formed in a spiral configuration as shown in FIG. 15.

Consequently, since the scattered mascara A is held between the spiral protruding parts 15, the mascara held between the protruding parts 15 can be replenished merely by rotating the cosmetic coating implement about the shaft member 1. Accordingly, there is no need for any complex liquid adding operation.

As was described above in detail, the present invention makes it possible to apply mascara to the eyelashes in an appropriate amount. Furthermore, excess mascara adhering to the eyelashes can be adjusted by being scraped away or dissolved. Moreover, the mascara can be replenished without adding mascara by inserting the implement into the container a number of times, so that a cosmetic coating implement that makes it possible to reduce complex liquid adding operations can be provided. Moreover, balls or bundles of excess adhering mascara can be dissolved, so that a cosmetic coating implement that makes it possible to blend the mascara into the eyelashes without any irregularities can be provided.

The present invention can provide a cosmetic coating implement [i] which can apply mascara or the like to the eyelashes as a coating in appropriate amounts, [ii] which can adjust mascara adhering to the eyelashes in excessive amounts by scraping away or dissolving this mascara, [iii] which can replenish mascara without inserting the implement into the container a number of times and adding mascara, and [iv] which can reduce complicated operations of adding liquid. Furthermore, the present invention can provide a cosmetic coating implement which can dissolve balls or bundles of excessively adhering mascara, and which can blend mascara into the eyelashes without any irregularities.

The invention claimed is:

1. A cosmetic coating implement for applying a cosmetic material comprising a coating part in which a plurality of brush bristles are disposed on a shaft member formed of spiral core wires and a holding part which is held in order to use said coating implement and connected to said shaft member, wherein said brush bristles disposed on said shaft member have at least two protruding parts consisting of curved surfaces comprising at least two protruding parts with respect to a direction of length of said shaft are formed by said plurality of brush bristles, each of said curved surfaces starts and ends at said shaft member at two separate spaced apart points along said direction of length on said shaft member, said curved surfaces are consecutively and symmetrically disposed along said direction of length of said shaft member without a space between starting and ending, said curved surfaces are points of consecutive ones of said curved surfaces of said protruding points substantially elliptical in shape with respect to the direction of length of said shaft with a long axis of said elliptical shape along said direction of length of said shaft, and one of said at least two protruding parts is at an end of said shaft member with brush bristles extending beyond said end by an amount equal to a length of said brush bristles, whereby said cosmetic coating implement is provided with a soft tip end.

2. The cosmetic coating implement according to claim 1, wherein at least three protruding parts are connected to said shaft member.

3. A cosmetic coating implement for applying a cosmetic material comprising a coating part in which a plurality of brush bristles are disposed on a shaft member formed of spiral core wires and a holding part which is held in order to use said coating implement and connected to said shaft member, wherein said brush bristles disposed on said shaft member have at least two protruding parts consisting of curved surfaces consecutively provided with respect to a direction of length of said shaft are formed by said plurality of brush bristles, said curved surfaces are disposed in a spiral configuration with said shaft member, said curved surfaces each starting and ending at said shaft and at separate spaced apart points along said direction of length of said shaft member without a space between starting and ending points of consecutive ones of said curved surfaces of said protruding parts, said curved surfaces are substantially elliptical in shape with respect to the direction of length of said shaft with a long axis of said elliptical shape along said direction of length of said shaft, and one of said at least two protruding parts is at an end of said shaft member with brush bristles extending beyond said end by an amount equal to a length of said brush bristles, whereby said cosmetic coating implement is provided with a soft tip end.

4. The cosmetic coating implement according to any of claims 1 or 3 being characterized in that said brush bristles are varied in direction with respect to said shaft member.

5. The cosmetic coating implement according to any of claims 1 or 3 being characterized in that said cosmetic coating implement is accommodated in a cosmetic material-accommodating container.

* * * * *